US006580890B2

(12) United States Patent
Phillips et al.

(10) Patent No.: US 6,580,890 B2
(45) Date of Patent: Jun. 17, 2003

(54) CLEAR TONER FOR CONDITIONING OF DEVELOPMENT SYSTEMS

(75) Inventors: Quintin T. Phillips, Boise, ID (US); Robin P. Yergenson, Eagle, ID (US); K. Trent Christensen, Boise, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/012,790

(22) Filed: Nov. 5, 2001

(65) Prior Publication Data

US 2003/0086726 A1 May 8, 2003

(51) Int. Cl.[7] ..... G03G 15/08

(52) U.S. Cl. ..... 399/222; 399/252; 399/253

(58) Field of Search ..... 399/13–15, 24, 399/27, 28, 127, 222, 223, 253, 252

(56) References Cited

U.S. PATENT DOCUMENTS

| | | | | |
|---|---|---|---|---|
| 5,512,988 | A | 4/1996 | Donaldson | |
| 5,758,234 | A | 5/1998 | Binder et al. | 399/127 |
| 6,075,548 | A | 6/2000 | Gillen | 347/139 |
| 6,226,463 | B1 | 5/2001 | Phillips et al. | 399/24 |

*Primary Examiner*—William J. Royer

(57) ABSTRACT

A toner deliver system, such as a development roller, in an electrophotographic printer is conditioned with clear toner particles. The clear toner particles are made of similar resins and contains all of the flow and charge agents of color toner particles, but does not contain any pigment.

12 Claims, 2 Drawing Sheets

CLEAR TONER FOR CONDITIONING OF DEVELOPMENT SYSTEMS

TECHNICAL FIELD

The present invention relates generally to electrophotographic printers and copiers employing color toners, and, more particularly, to conditioning components of the toner development systems by exposure to toner or a toner-like substance prior to use.

BACKGROUND ART

Color electrophotographic printing processes have a unique challenge in the toner development systems currently in use. The toner developing systems for both roll type and two part type developers require that the components of the system be exposed to toner prior to use; that is, when installing a new cartridge to replace an exhausted cartridge. The initial exposure to the toner is to provide sufficient time and energy for the particles of toner to properly adhere to the surfaces of the development system. This exposure is called "conditioning".

Conditioning may occur at the factory of manufacture or by extended operation in the printer prior to use. The conditioning is required to properly prepare the surfaces so that new supplies of additional toner can be delivered to the system and quickly incorporated in the charging and development process. The conditioning also acts to lubricate and protect various components and sensitive interfaces in the development system from damage during initial use, shipping, and storage. The toner may also provide a protective cover which mitigates the effect of accidental contact with skin oil from handling.

Currently, conditioning for all toner cartridge colors is done using yellow toner. A single color of toner was selected to improve the speed and efficiency of the manufacturing process. Further, the developer rollers or media can all be conditioned independent of the final assembly. Yellow toner has been selected because it has the least effect on other toner colors. The small amount of toner which is left on the developer roller or carrier beads is more quickly diluted by the stronger color strength of the cyan or magenta colors.

However, there are several problems that exist with this approach.

First, a usability problem has been identified with this approach. Customers, unfamiliar with the phenomena of yellow being used as a conditioning color, have returned cartridges of magenta and cyan to the manufacturer, claiming the cartridge contained the wrong color of toner. They have purchased a cyan cartridge and opened the cartridge to find yellow toner on the developer roller. Thus, customers are receiving a mixed message in the case of cyan and magenta toners—the obvious color of toner on the developer roller does not correspond with the expected color of toner purchased.

An additional usability issue concerns the "toner mess" associated with changing a toner cartridge. In an effort to reduce cost in the products, shutters over the development systems have been eliminated. However, this elimination results in exposing customers' hands, clothing, and office equipment to color toner while handling the toner cartridges.

Finally, a print quality (PQ) problem also exists. While dilution occurs quickly, there still can be discernable amounts of yellow in the printed image of the first couple of pages which are printed. This is especially notable because yellow is a significant component of two important "memory colors". Red colors or the green of grass are challenging colors in which the hue of the color must be matched very closely for customer satisfaction. As a result, if a toner cartridge for magenta or cyan is changed in the middle of a print job and the job contains these colors, there is a high probability that the hue will be unacceptable as a result of the additional yellow being deposited in the secondary color.

Thus, there is a need to provide a solution that solves most, if not all, of the foregoing problems without creating new problems.

DISCLOSURE OF INVENTION

In accordance with the present invention, a method is provided for conditioning development systems in electrophotographic-based printers employing color toners, comprising:

(a) providing clear toner particles; and (b) causing the clear toner particles to initially be moved through the development systems and then transferred and fused on a print medium prior to printing other toner particles thereon.

Thus, clear toner is used to condition the development systems. The clear toner is made of similar resins and contains all of the flow and charge agents of the color toners, but does not contain any pigment.

Since the toner is clear, the toner is not visible to customers and therefore will not cause confusion or give conflicting information regarding the color of the toner contained in the cartridge.

Also since the toner is clear, the toner will not stain the hands or clothing of individuals handling the shutter-less cartridges, thereby reducing the "toner mess" problem.

Finally, print quality is improved where a toner cartridge containing magenta or cyan is changed in the middle of a print job, since only clear toner is deposited on the first few pages being printed.

BEST MODES FOR CARRYING OUT THE INVENTION

Figure 1:
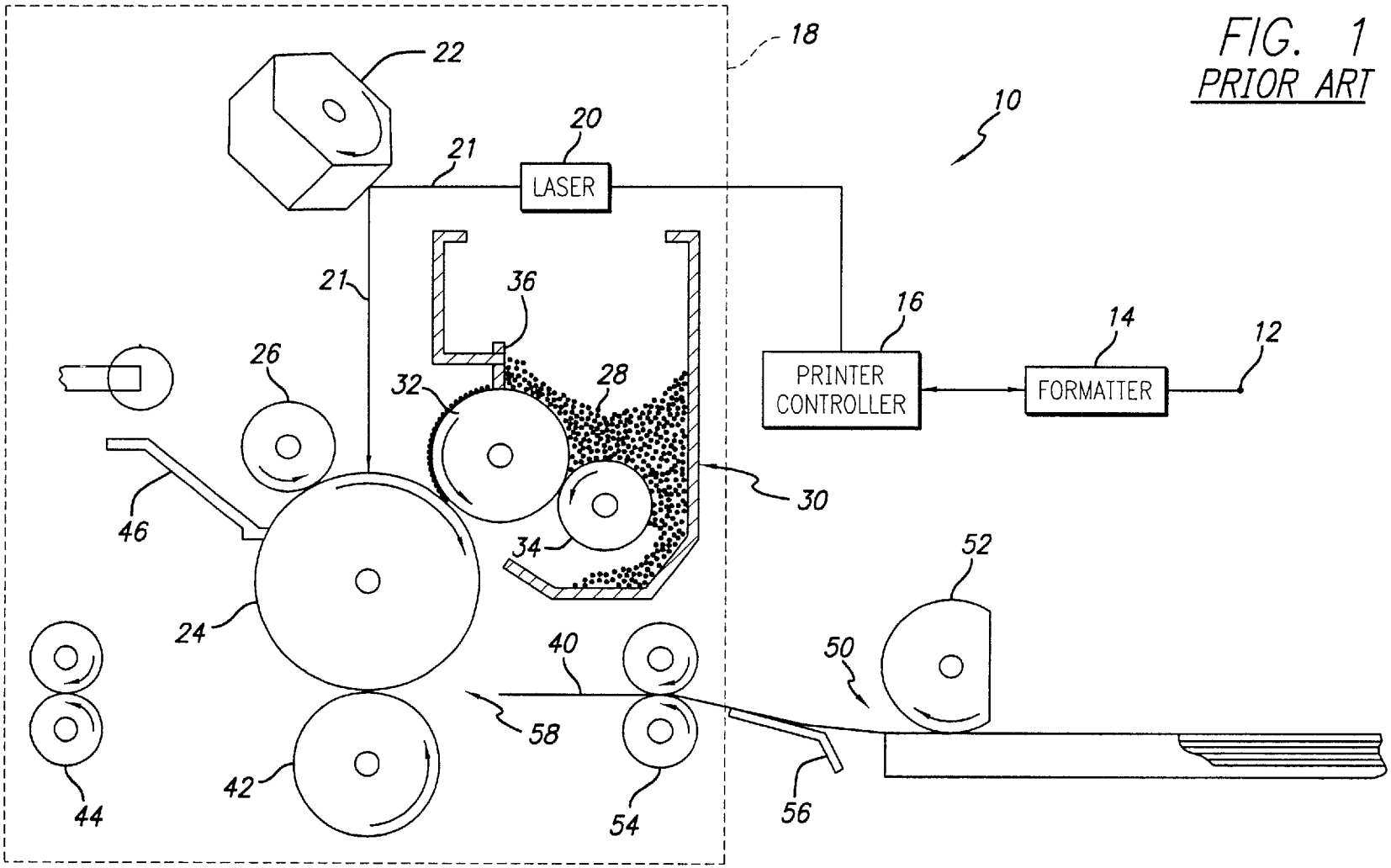
FIG. 1 PRIOR ART
FIG. 1 is a schematic elevation view of a conventional laser printer.

FIG. 1 schematically depicts the basic components of a laser printer 10. Inasmuch as the art of electrophotographic laser printing is well-known, the basic components of the laser printer 10 are shown schematically and their operation described only briefly. In this connection, it will be appreciated that while the description that follows is presented in terms of a laser printer, the teachings of the present invention, which are directed to the toner, are equally applicable to photocopy machines and facsimile machines based on electrophotographic processes.

In general, a computer (not shown) transmits data representing a print image to an input port 12 of the printer 10. This data is analyzed in a formatter 14, which typically consists of a microprocessor and related programmable memory and page buffer. The formatter 14 formulates and stores an electronic representation of each page to be printed. Once a page has been formatted, it is transmitted to a page buffer (not shown). The page buffer breaks the electronic page into a series of lines or "strips" one dot wide. This strip of data is then sent to a printer controller 16. The printer controller 16, which also includes a microprocessor and related programmable memory, directs and manages the operations of a print engine 18. Each strip of data is used to modulate a light beam 21 produced by a laser 20 such that the beam of light "carries" the data. The light beam 21 is reflected off a multifaceted spinning mirror 22. As each facet of the mirror 22 spins through the light beam 21, it reflects or "scans" the beam across the surface of a photoconductive drum 24. The photoconductive drum 24 rotates about a motor-driven shaft such that the photoconductive drum 24 advances just enough that each successive scan of the light beam 21 is recorded on the photoconductive drum 24 immediately after the previous scan. In this manner, each strip of data from the page buffer is recorded on the photoconductive drum 24 as a line, one after the other, to reproduce the page on the photoconductive drum 24.

A charging roller 26 charges the photoconductive drum 24 to a relatively high, substantially uniform negative (or positive) polarity at its surface. A corona-type charge generating device may be used in place of the charging roller 26.

For discharge area development (DAD), such as that used in laser printers, the areas on the fully charged photoconductive drum 24 exposed to the light beam 21 from the laser 20 represent the desired print image. The exposed areas of the photoconductive drum 24 are partially or fully discharged, depending on the intensity of the light beam 21 and the duration of exposure. The unexposed background areas of the photoconductive drum 24 remain fully charged. This process creates a latent electrostatic image on the photoconductive drum 24.

For charge area development (CAD), such as that used in photocopiers, the background areas on the photoconductive drum 24 are exposed to the light beam 21. The unexposed areas of the photoconductive drum 24 represent the desired print image.

For DAD processes, the toner particles are charged to the same polarity as the photoconductive drum 24, as described below. For CAD processes, the toner particles are charged to a polarity opposite that of the photoconductive drum 24.

Figure 2:
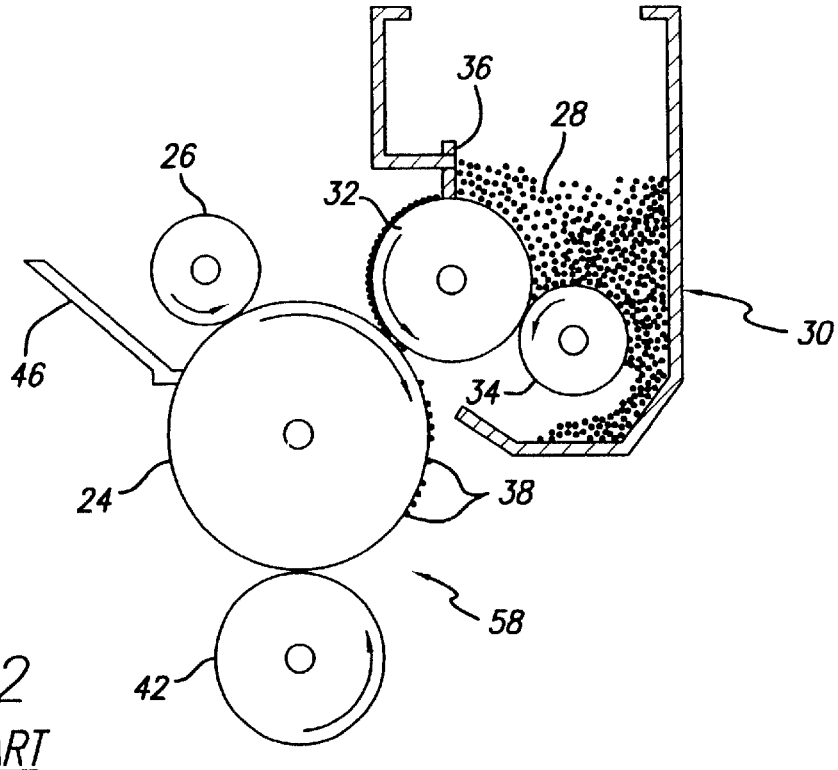
FIG. 2 PRIOR ART
FIG. 2 is a detailed elevation view of the toner applicator unit and photoconductive drum components of the print engine for the laser printer of FIG. 1.

Toner particles 28 are triboelectrically charged in a toner application unit 30 to the same negative (or positive) polarity as the photoconductive drum 24. The toner application unit 30 includes a developer roller 32 positioned adjacent a charge applicator roller 34 and a metering blade 36. The developer roller 32 is electrically biased to repel the charged toner particles 28 to the discharged image areas on the photoconductive drum 24. The fully charged background areas also repel toner particles 28 onto the discharged image areas. In this way, the toner is transferred to the photoconductive drum 24 to form developed toner images 38 shown in FIG. 2.

The toner images 38 are transferred from the photoconductive drum 24 onto paper 40 as the paper passes between the photoconductive drum 24 and a transfer roller 42. The transfer roller 42 is electrically biased to impart a relatively strong positive charge to the back side of the paper 40 as it passes by the photoconductive drum 24. The positive charge attracts the negatively-charged toner particles 28 and pulls it from the photoconductive drum 24 to form the image on the paper 40. The toner images 38 are then fused to the paper 40 as the paper passes between a pair of heated fusing rollers 44. The photoconductive drum 24 is cleaned of excess toner with a cleaning blade 46. Each sheet of paper 40 is pulled into a pick/feed area 50 by a feed roller 52. As the leading edge of the paper 40 moves through the pick/feed area 50, it is engaged between a pair of registration rollers 54. A ramp 56 helps guide the paper 40 into the registration rollers 54. The registration rollers 54 advance the paper 40 fully into an image area 58 until it is engaged between the photoconductive drum 24 and the transfer roller 42, and toner particles 28 are applied as described above.

Figure 3:
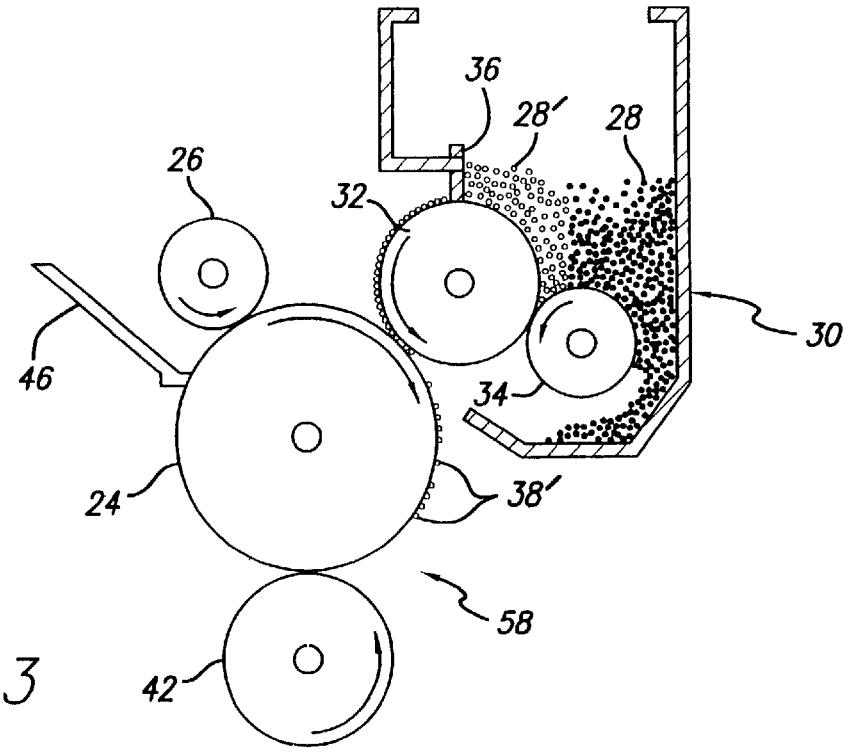
FIG. 3 is a view similar to that of FIG. 2, but including the clear toner particles of the present invention.

In accordance with the present invention, and with reference to FIG. 3, clear toner particles, or conditioner, 28' are initially transferred onto the photoconductive drum 24 from a fresh toner application unit 30. In one embodiment, as shown in FIG. 3, the clear toner particles 28' may be provided, or assembled, as an initial charge in the toner application unit 30 so that the first few pages that are printed are printed with clear toner images 38' from the clear toner particles 28' only, so as to properly condition the development units, e.g., developer roller 32. In another embodiment, the developer-roller 32 itself is coated with clear toner particles 28', such as by spraying, dipping, or painting the developer roller, such as by brushing or rolling using a counter-rotating foam roll. Since the consumable that is replaced by the consumer includes at least both the toner application unit 30 and the developer roller 32, either approach is conventiently performed by the manufacturer of the consumable.

The clear toner particles 28' of the present invention are substantially identical in composition to the color toner particles presently used in electrophotographic printing units, but are devoid of any pigment. Thus, the clear toner particles 28' are made of similar resins and contain all the flow and charge agents of the color toners.

The use of clear toner particles 28' in accordance with the teachings herein mitigates the above-discussed problems. In the first instance, the clear toner particles 28' are not visible to the customer and therefore will not cause confusion or give conflicting information regarding the color of the toner particles 28 contained in the cartridge. In addition, the clear toner particles 28' will not stain the hands or clothing of individuals handling the shutter-less cartridges. In a second instance, the clear toner particles 28' minimize the impact on hue because the clear toner particle 28' add only neutral color to the printing process. The initial revolutions of the developer roller will more quickly dilute the clear toner particles 28' with the toner particles 28 of appropriate color. Finally, clear toner particles 28' for the conditioning of the development systems will help resolve usability issues as well as print quality issues in color printers.

INDUSTRIAL APPLICABILITY

The use of clear toner particles to condition development systems is expected to find use in color printers, photocopiers, and facsimile machines that employ color toners.

What is claimed is:

1. A method for conditioning development systems in electrophotographic-based printers employing color toner particles prior to first use of said color toner particles, comprising the steps of:

(a) providing clear toner particles; and (b) causing said clear toner particles to initially be moved through said development systems and then transferred and fused on a print medium prior to printing other toner particles thereon.

2. The method of claim 1 wherein said clear toner particles are included as an initial charge in a toner application unit that contains both clear toner particles and color toner particles, which are transferred by a developer roller to a rotating photoconductive drum.

3. The method of claim 1 wherein said clear toner particles are provided on a developer roller that transfers toner particles from a toner application unit to a rotating photoconductive drum.

4. The method of claim 1 wherein said clear toner particles have a composition that is essentially the same as that of said color toner particles, but is devoid of any pigment.

5. A method for conditioning development systems in electrophotographic-based printers employing color toner particles prior to first use of said color toner particles, comprising the steps of:

(a) providing clear toner particles as an initial charge in a toner application unit that contains both clear toner particles and color toner particles, which are transferred by a developer roller to a rotating photoconductive drum; and (b) causing said clear toner particles to initially be moved through said development systems and then transferred and fused on a print medium prior to printing other toner particles thereon.

6. The method of claim 5 wherein said clear toner particles have a composition that is essentially the same as that of said color toner particles, but is devoid of any pigment.

7. A method for preparing a conditioner for conditioning development systems in electrophotographic-based printers employing color toner particles prior to first use of said color toner particles, comprising the steps of:

(a) providing clear toner particles; and (b) disposing said clear toner particles so as to cause said clear toner particles to initially be moved through said development systems and then transferred and fused on a print medium prior to printing other toner particles thereon.

8. The method of claim 7 wherein said clear toner particles are placed as an initial charge in a toner application unit that contains both clear toner particles and color toner particles, which are transferred by a developer roller to a rotating photoconductive drum.

9. The method of claim 7 wherein said clear toner particles are formed on a developer roller that transfers toner particles from a toner application unit to a rotating photoconductive drum.

10. The method of claim 7 wherein said clear toner particles have a composition that is essentially the same as that of said color toner particles, but is devoid of any pigment.

11. A method for preparing a conditioner for conditioning development systems in electrophotographic-based printers employing color toner particles prior to first use of said color toner particles, comprising the steps of:

(a) providing clear toner particles; and (b) disposing said clear toner particles as an initial charge in a toner application unit that contains both clear toner particles and color toner particles so that said clear toner particles will initially be moved through said development systems and then transferred and fused on a print medium prior to printing other toner particles thereon.

12. The method of claim 11 wherein said clear toner particles have a composition that is essentially the same as that of said color toner particles, but is devoid of any pigment.

* * * * *